US008418745B2

(12) United States Patent
Cogan et al.

(10) Patent No.: US 8,418,745 B2
(45) Date of Patent: Apr. 16, 2013

(54) POUR LADLE FOR MOLTEN METAL

(71) Applicant: GM Global Technology Operations LLC, Detroit, MI (US)

(72) Inventors: Christopher D. Cogan, Defiance, OH (US); Stephen M. Fitch, Oakwood, OH (US); Qigui Wang, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 13/648,293

(22) Filed: Oct. 10, 2012

(65) Prior Publication Data

US 2013/0032304 A1 Feb. 7, 2013

Related U.S. Application Data

(62) Division of application No. 13/115,211, filed on May 25, 2011, now Pat. No. 8,327,915.

(51) Int. Cl.
*B22D 41/00* (2006.01)

(52) U.S. Cl.
USPC ..... 164/119; 164/136

(58) Field of Classification Search ..... 164/33–337; 222/594–595, 603, 606, 629
See application file for complete search history.

(56) References Cited

U.S. PATENT DOCUMENTS

| | | | | |
|---|---|---|---|---|
| 3,605,863 | A | 9/1971 | King | |
| 3,999,593 | A | 12/1976 | Kaiser | |
| 4,010,876 | A * | 3/1977 | Steinemann | 222/595 |
| 4,747,443 | A | 5/1988 | Wilson | |
| 5,215,141 | A | 6/1993 | Kuhn et al. | |
| 5,390,724 | A * | 2/1995 | Yamauchi et al. | 164/147.1 |
| 2004/0050525 | A1 * | 3/2004 | Kennedy et al. | 164/306 |
| 2004/0112563 | A1 * | 6/2004 | Eljaala et al. | 164/134 |

FOREIGN PATENT DOCUMENTS

| | | | |
|---|---|---|---|
| SU | 337422 | A | 10/1970 |

* cited by examiner

*Primary Examiner* — Kuang Lin
(74) *Attorney, Agent, or Firm* — Fraser Clemens Martin & Miller LLC; J. Douglas Miller

(57) ABSTRACT

A method of forming a casting using a casting apparatus is disclosed, the method including the steps of lowering a ladle having a hollow interior into a source of molten material and an aperture facilitating flow into the hollow interior, filling the interior of the ladle with the molten material through the aperture, introducing an inert gas into a portion of a nozzle, removing the ladle from the source of molten material, causing the nozzle to contact a casting mold, and pressurizing the hollow interior with an inert gas to cause the molten material to flow into the casting mold.

20 Claims, 5 Drawing Sheets

POUR LADLE FOR MOLTEN METAL

CROSS-REFERENCE TO RELATED APPLICATION

This application is a divisional application of U.S. patent application Ser. No. 13/115,211 filed on May 25, 2011, hereby incorporated herein by reference in its entirety.

FIELD OF THE INVENTION

This invention relates to an apparatus and method for filling a ladle with a molten material and transferring the molten material from the ladle to a casting mold.

BACKGROUND OF THE INVENTION

The pouring of a molten material such as metal, for example, into a casting mold is a significant process variable that influences the internal soundness, surface conditions, and mechanical properties, such as tensile strength, porosity, percent elongation, and hardness, of a cast object. Many different designs for dipping/pouring ladles exist and are used in the foundry industry. Foundries typically use either a high pressure die casting (HPDC) process or a gravity pour casting method. Ladles are typically used in foundries for transporting pre-measured quantities of molten metal from a holding furnace to a casting machine. Molten metal is then poured from the ladle into a receptacle of the casting machine, for example into a shot sleeve in an HPDC process or a pouring basin in a gravity pour casting process. For large scale production casting processes, the ladle is normally mounted on a mechanical or robotic handling device, which is programmed to dip the ladle into the holding furnace to obtain a desired amount of molten metal. The robotic handling device then transports the metal to the casting machine and causes a pouring of the metal from the ladle into the casting machine.

Using conventional casting methods, casting ladles, and robotic handling devices, a great deal of turbulence can be generated while dipping the ladle into the holding furnace. For aluminum alloys, this turbulence can cause the formation of oxides, commonly referred to as dross, or other impurities that may adversely affect the quality of the casting. Electromagnetic pumps have been increasingly used in transferring molten metal to a casting mold. Since the electromagnetic pump is immersed in the molten metal, surface turbulence and the generation of oxides associated with a traditional ladle are minimized. However, electromagnetic pumps may be expensive and difficult to maintain and repair. Furthermore, the electromagnetic pump needs to be energized at all times to generate a bias voltage to minimize oxide formation in the electromagnetic pump and launder system. Also, cooling air required by electromagnetic pumps may create a variation in the temperature of the molten metal from an initial melt temperature.

Additives may be introduced to the molten metal to modify microstructure and to add strength to a casting formed from the molten metal. Additives include those such as titanium carbon aluminum, titanium aluminum, aluminum strontium, and titanium boron. The additives act as nucleating agents within the molten metal to control crystal formation during solidification of the molten metal. Additives such as titanium boron tend to evaporate quickly when added to a heated ladle. Therefore, the additives must be strategically added to the molten metal to ensure that the additive does not evaporate prior to mixing with the molten metal, and the additive must be adequately and uniformly mixed with the molten metal.

Without proper mixing of the additive(s) with the molten metal, an undesirable casting may be produced.

It would be desirable to provide an improved pour ladle that addresses the disadvantages of conventional pour ladle and electromagnetic pumps while ensuring a desired introduction and mixing of an additive into a molten metal. Thus, it would be desirable to provide an apparatus and method for quiescently filling a ladle with molten metal and an additive, and for transferring the molten metal from the ladle to a casting mold to minimize turbulence in the molten metal to minimize defects in the desired cast object formed by a tilt pour molding process.

SUMMARY OF THE INVENTION

Concordant and congruous with the present invention, an apparatus and method for quiescently filling a ladle with molten metal and an additive, and for transferring the molten metal from the ladle to a casting mold to minimize turbulence in the molten metal to minimize defects in the desired cast object formed have surprisingly been discovered.

In one embodiment, a casting apparatus comprises a ladle having a hollow interior; a nozzle in fluid communication with the hollow interior, the nozzle having a first portion disposed outside of the ladle and a second portion disposed within the hollow interior; an additive feeder in communication with the hollow interior of the ladle; and a gas conduit in fluid communication with the hollow interior of the ladle.

In another embodiment, a casting apparatus comprises a ladle having an opening in fluid communication with a hollow interior thereof and an aperture formed in a bottom thereof, the ladle adapted to receive a molten material therein; a nozzle in fluid communication with the hollow interior, the nozzle having a first portion disposed outside of the ladle and a second portion disposed within the hollow interior; a lid disposed on the opening and forming a fluid-tight seal therewith; an additive feeder in fluid communication with the hollow interior of the ladle; a gas conduit in fluid communication with the hollow interior of the ladle; and a stopper assembly having a stopper rod disposed through the lid with a portion thereof disposed in the hollow interior and a stopper disposed on a first end thereof adapted to selectively plug the aperture.

In another embodiment, a method of transferring a molten material to a casting mold comprises the steps of lowering a ladle having a hollow interior into a source of molten material and an aperture facilitating flow into the hollow interior; filling the interior of the ladle with the molten material through the aperture; introducing an inert gas into a portion of a nozzle; removing the ladle from the source of molten material; causing the nozzle to contact a casting mold; and pressurizing the hollow interior with an inert gas to cause the molten material to flow into the casting mold.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DETAILED DESCRIPTION OF THE EMBODIMENTS

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
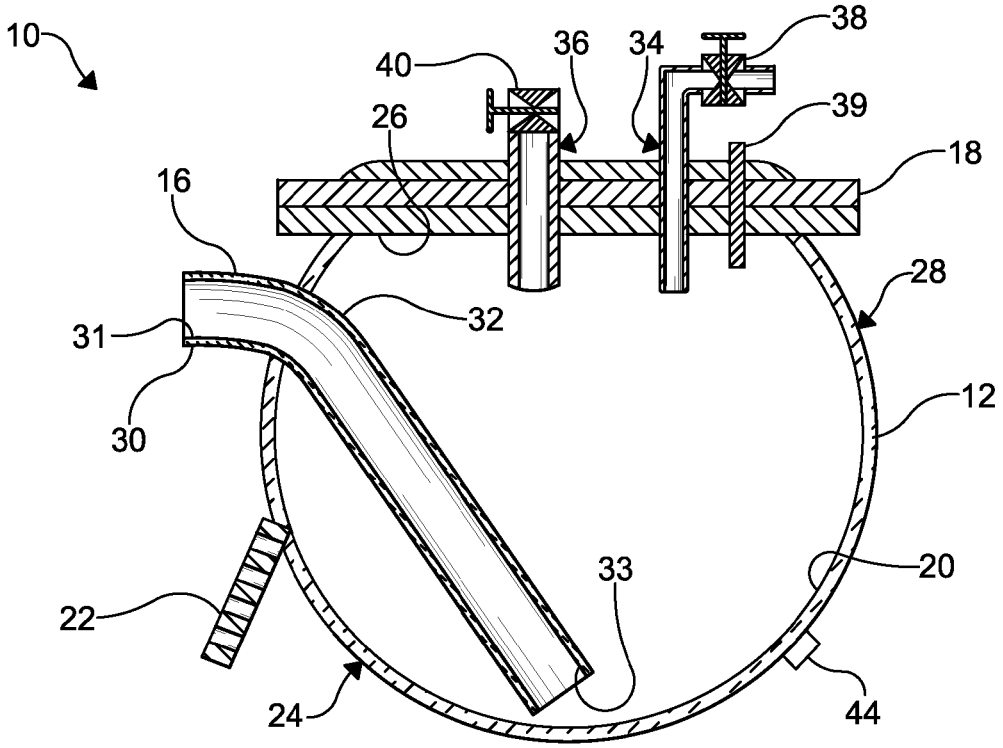
FIG. 1 is a cross-sectional elevational view of a casting apparatus according to an embodiment of the invention.

FIG. 1 shows a casting apparatus 10 according to an embodiment of the invention. The casting apparatus 10 includes a ladle 12 adapted to receive a molten material 14 (shown in FIGS. 2-5) therein, a nozzle 16 providing fluid communication with a hollow interior 20 of the ladle 12, and a lid 18 forming a substantially fluid-tight seal between the interior 20 and the atmosphere. It is understood that the molten material 14 may be any molten material such as a metal, for example steel, aluminum, and alloys thereof, or a polymeric material, as desired.

The ladle 12 is a quiescent-fill ladle having a dross skimmer 22 disposed on an exterior thereof. As used herein, the term "quiescent-fill ladle" is defined as a ladle adapted to receive a molten material therein with a minimized amount of turbulence, agitation, and folding of the molten material 14. The ladle 12 has a substantially circular cross-sectional shape, but the ladle 12 may have any cross-sectional shape such as rectangular, triangular, ovoid, and the like, for example. The ladle 12 may be formed from any conventional refractory material such as a ceramic or a metal, for example, as desired. The dross skimmer 22 is a sieve adapted to skim solid material from a liquid material. The dross skimmer 22 may be a solid material including a plurality of apertures through which the molten material 14 is allowed to pass, or the dross skimmer 22 may be a mesh. The dross skimmer 22 is typically disposed on the same side of the ladle 12 as the nozzle 16 adjacent a bottom 24 of the ladle 12. However, the dross skimmer 22 may be disposed anywhere on the ladle 12, as desired. The dross skimmer 22 may be formed from any number of non-metallic materials adapted to withstand the elevated temperature of molten metals, such as graphite or silicon carbide, for example. An opening 26 formed in a top 28 of the ladle 12 provides fluid communication with the interior 20 thereof. The opening 26 may have any size and shape as desired. In the embodiment shown, the lid 18 forms a fluid-tight seal with a portion of the ladle 12 forming the opening 26. The fluid-tight seal may be formed by welding the lid 18 to the ladle 12, with an adhesive, and the like, for example. Alternatively, the lid 18 may be integrally formed with the ladle 12, or the ladle 12 may be formed in such a way that no lid 18 is required.

The nozzle 16 is a hollow conduit providing fluid communication with the interior 20 of the ladle 12. The nozzle 16 is disposed through a sidewall of the ladle 12 adjacent the opening 26. The nozzle 16 includes a first portion 30 extending outwardly from the ladle 12 to an exterior thereof and a second portion 32 extending into the interior 20 of the ladle 12. The first portion 30 includes an aperture 31 facilitating flow through the nozzle 16. The second portion 32 includes an aperture 33 facilitating flow through the nozzle 16. The first portion 30 has an inner diameter larger than an inner diameter of the second portion 32, but the portions 30, 32 may have the same inner diameter or the second portion 32 may have a larger inner diameter than an inner diameter of the first portion 30, as desired. The second portion 32 is formed at an angle with respect to the first portion 30. The second portion 32 terminates adjacent the bottom 24 of the interior 20 of ladle 12 to minimize a drop of the molten material 14 during a filling of the ladle 12, thereby facilitating a quiescent fill thereof. As shown, the nozzle 16 has a circular cross-section, but the nozzle 16 may have any cross-sectional shape, as desired. The nozzle 16 is formed from refractory material such as a ceramic or a metal, for example, as desired.

The lid 18 forms a substantially fluid-tight seal between the interior 20 of the ladle 12 and the atmosphere, and includes a gas conduit 34 providing fluid communication with the interior 20, an additive feeder 36 providing communication with the interior 20, and a pressure sensor 39 in communication with the interior 20. As shown, the lid 18 is formed from stainless steel, but the lid 18 may be formed from any resilient material adapted to withstand the elevated temperatures of a molten metal. The gas conduit 34 and the additive feeder 36 each include a portion disposed through and forming a substantially fluid tight seal with the lid 18. The gas conduit 34 includes a means for regulating flow 38 such as a valve, for example, from a source of a gas (not shown) to the interior 20 of the ladle 12. The additive feeder 36 includes a means for regulating communication 40 such as a valve, for example, from a source of an additive (not shown) to the interior 20 of the ladle 12. The source of an additive may be an individual introducing a desired amount of an additive (not shown) to the interior 20 or an additive feeder, such as a KB Alloys Rod Feeder sold by KB Alloys, Inc. of Reading, Pa. It is understood that the additive feeder 36 may be an additive feeder mounted directly to the apparatus 10 rather than a conduit and means for regulating communication in communication with an additive feeder. The additive added to the interior 20 may be titanium carbon aluminum, titanium aluminum, aluminum strontium, or titanium boron, for example, as desired. The gas conduit 34 and the additive feeder 36 may be formed from the same material or different materials such as stainless steel or a ceramic, for example, as desired. The pressure sensor 39 is adapted to detect the pressure of gaseous fluids within interior 20 of the apparatus 10. The pressure sensor 39 may be in electrical communication with a computer or controller or other device adapted to receive and interpret pressure readings therefrom for fluid pressurization profile feedback and control.

FIGS. 2-5 illustrate the various positions of the casting apparatus 10 during use. The casting apparatus 10 is transported and/or rotated by a robotic handling device (not shown) as known in the art. The robotic handling device positions the casting apparatus 10 near the source of the additive with the additive feeder 36 in communication therewith. The means for regulating communication 40 is opened and a desired amount of additive from the source of the additive is introduced through the additive feeder 36 to the interior of the casting apparatus 10. Once the desired amount of additive has been introduced, the means for regulating communication 40 is closed and the casting apparatus 10 is transported to a dip well 42 of a furnace (not shown) for filling. To militate against the additive oxidizing prior to mixing with the molten material 14, the additive is introduced into the ladle 12 just prior to the filling thereof with the molten material 14.

Figure 2:
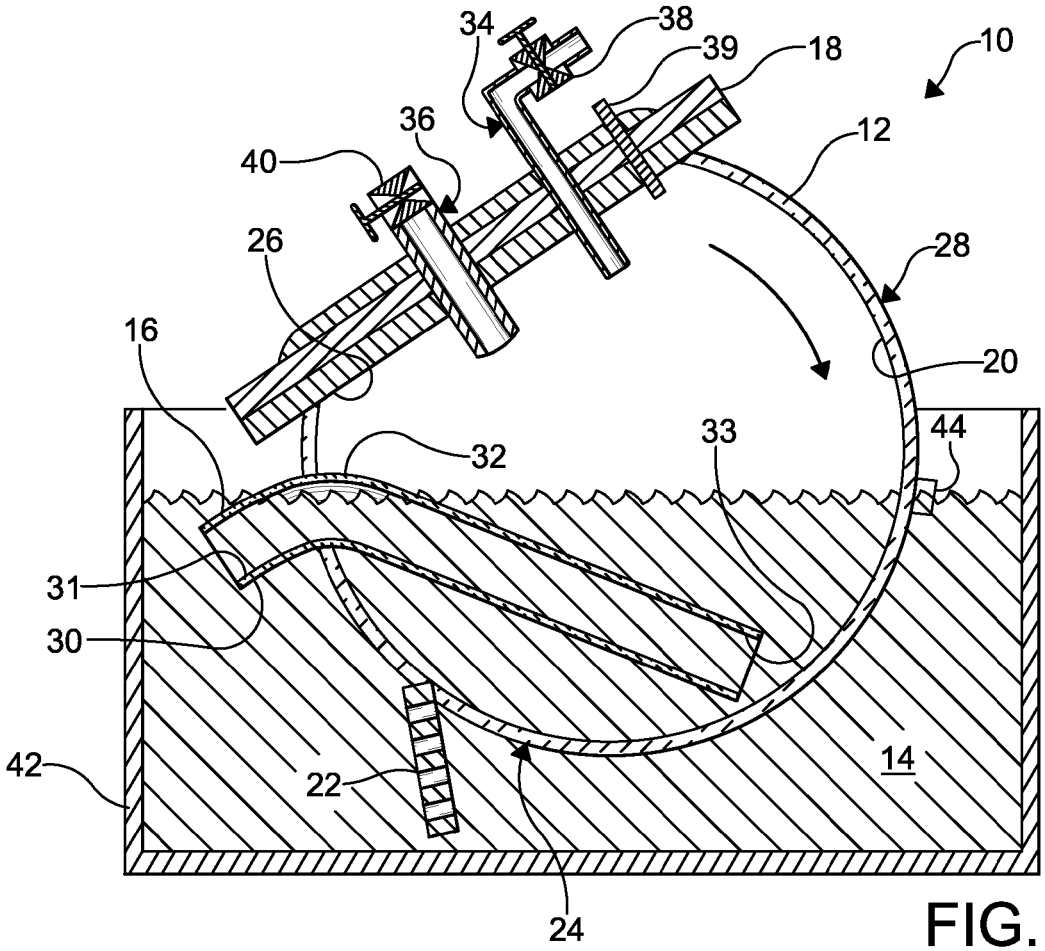
FIG. 2 is a cross-sectional elevational view of the casting apparatus of FIG. 1 and a dip well of a holding furnace, the casting apparatus rotated and lowered into the dip well for a filling operation.

To fill the casting apparatus 10 with the molten material 14, the casting apparatus 10 is lowered over the dip well 42 until at least a portion of the dross skimmer 22 is submerged in the molten material 14. Once the portion of the dross skimmer 22 is submerged in the molten material 14, the casting apparatus 10 is caused to move in a plane parallel to a plane of a top surface of the molten material 14 to cause the dross skimmer 22 to skim the top surface of the molten material 14 to remove dross therefrom. By removing dross from the top surface of the molten material 14, the casting apparatus 10 may be lowered into the molten material 14 in an area of the dip well 42 substantially free from dross. As shown in FIG. 2, the casting apparatus 10 is lowered into the molten material 14 and rotated until at least a portion of the first portion 30 of the nozzle 16 is submerged in the molten material 14. The casting apparatus 10 is lowered into the molten material 14 until a contact probe 44 disposed on an exterior of the ladle 12 is contacted by the molten material 14. Once the molten material 14 contacts the contact probe 44, a circuit is grounded which causes the robotic handling device to stop lowering the casting apparatus 10. Once the portion of the nozzle 16 is lowered into the molten material 14, the molten material 14 will flow from the dip well 42, through the aperture 31 of the first portion 30 of the nozzle 16, through the second portion 32 of the nozzle 16, from the aperture 33, and into the interior 20 of the ladle 12. Since the second portion 32 of the nozzle 16 terminates adjacent the bottom 24 of the ladle 12, the drop of the molten material 14 is minimized and the filling of the ladle 12 is quiescent.

Figures 3, 4:
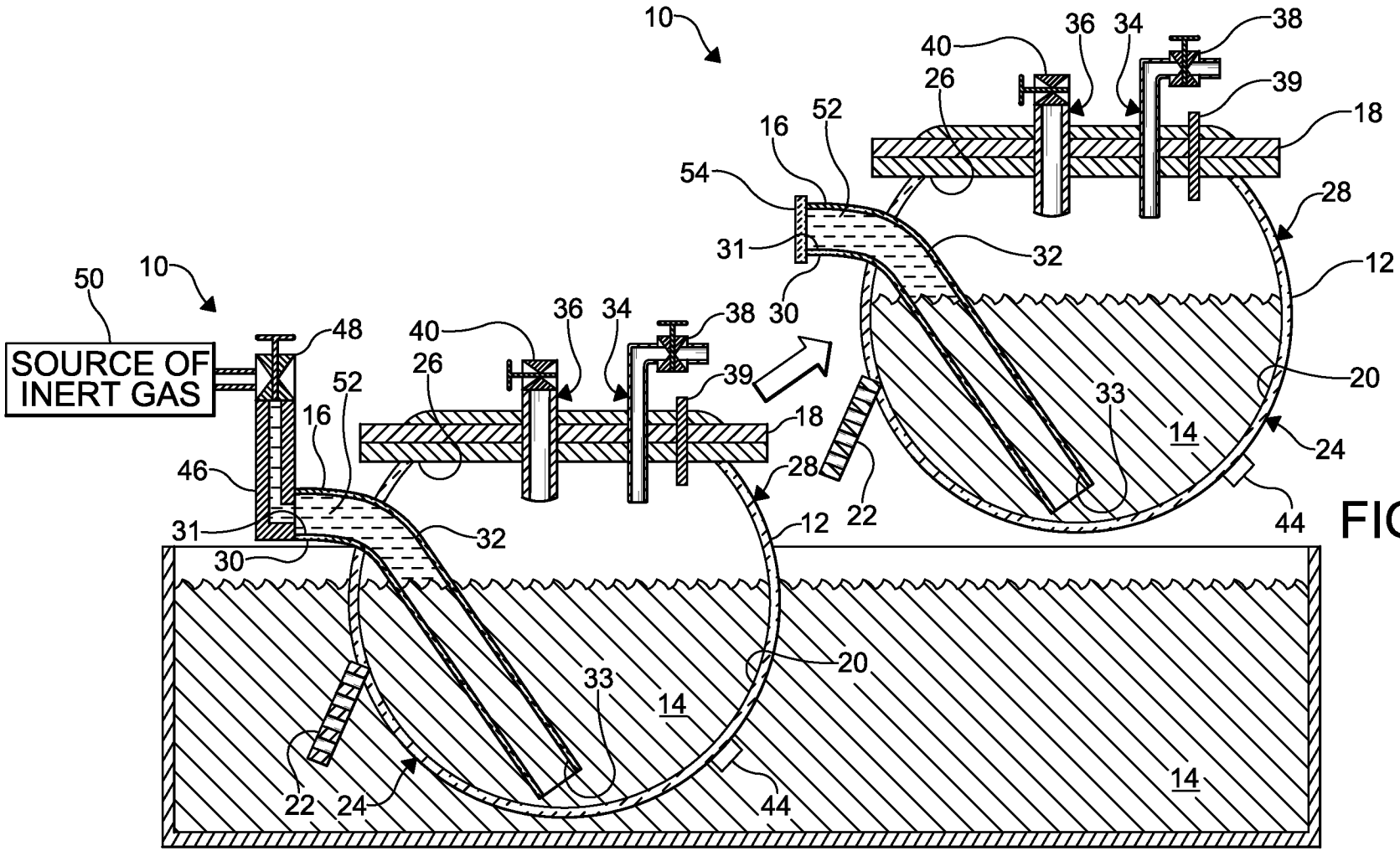
FIG. 3 is a cross-sectional elevational view of the casting apparatus and the dip well of FIG. 2 with the casting apparatus filled with a molten metal by the filling operation and within the dip well.
FIG. 4 is a cross-sectional elevational view of the casting apparatus of FIG. 3 removed from the dip well.

Once the ladle 12 of the casting apparatus 10 is filled with a desired amount of molten material 14, the casting apparatus 10 is rotated to an upright position with the lid 18 substantially parallel to the top surface of the molten material 14, as best shown in FIG. 3. A conduit 46 is then placed in contact and fluid communication with the first portion 30 of the nozzle 16. The conduit 46 is in fluid communication with a source of an inert gas 50 and includes a means for regulating flow 48 such as a valve, for example. The inert gas may be $N_2$, for example. The contact between the first portion 30 and the conduit 46 is substantially fluid tight. Once the first portion 30 and the conduit 46 are in fluid communication, the means for regulating flow 48 is opened and the portion of the nozzle 16 not filled with the molten material 14 is filled with an inert gas 52 from the source 50. The inert gas 52 may dilute the air (or another gas) in the nozzle 16, or the inert gas 52 may displace the air which is selectively vented from the nozzle 16. Once the nozzle 16 is filled with a desired amount of the inert gas 52, the means for regulating flow 48 is closed. By filling the nozzle 16 with an inert gas 52 after the apparatus 10 is filled with the molten material 14, oxidation of the molten material 14 is minimized. Once the means for regulating flow 48 is closed, contact between the conduit 46 and the first portion 30 is broken, and the aperture 31 of the nozzle 16 is sealed with a cover 54 to militate against the escape of the inert gas 52 therefrom, as shown in FIG. 4. The cover 54 may be hingedly or otherwise connected to the casting apparatus 10 or formed separately from the casting apparatus 10, as desired. The cover 54 may be a plug or other capping device, as desired. The casting apparatus 10 is then removed from the dip well 42 and the molten material 14 by the robotic handling device. Alternative to using the cover 54, the conduit 46 may remain in fluid-tight contact with the nozzle 16 during transport of the casting apparatus 10 from the dip well 42.

Figure 5:
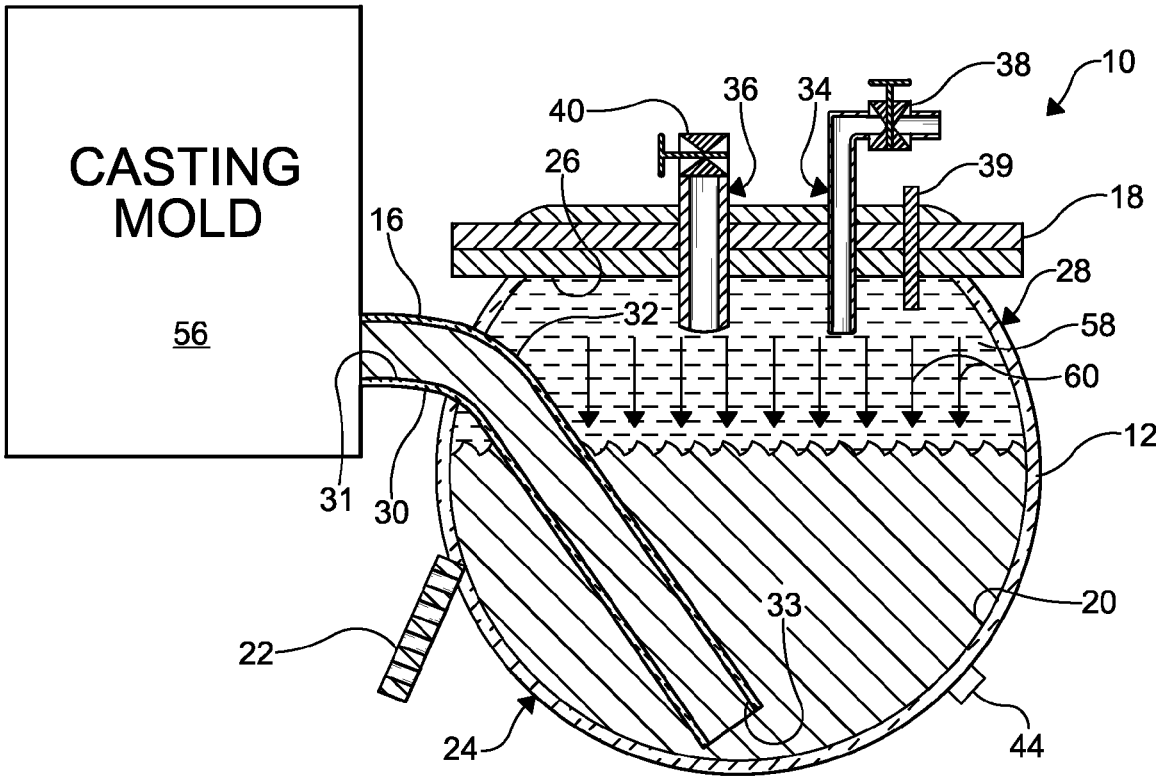
FIG. 5 is cross-sectional elevational view of the casting apparatus of FIG. 4 in fluid communication with a casting mold.

After filling, the casting apparatus 10 is transported by the robotic handling device to a casting mold 56, as best shown in FIG. 5. The cover 54 is removed from the aperture 31 of the nozzle 16 and the nozzle 16 is sealingly connected to the casting mold 56 with the aperture 31 in fluid communication with an aperture (not shown) formed in the casting mold 56. Once the casting apparatus 10 and the casting mold 56 are connected, the means for regulating flow 38 is opened and an inert gas 58 is caused to flow into the interior 20 to pressurize the ladle 12. As indicated by arrows 60, the pressure in the interior 20 causes a downward pressure on the molten material 14 and causes the molten material 14 to flow through the aperture 33, through the nozzle 16 and from the aperture 31 into the casting mold 56. Once the casting mold 56 is filled to a desired level, the means for regulating flow 38 is closed to stop the flow of inert gas 58 into the interior 20. Based on a fluid pressure measurement from the pressure sensor 39 and a desired flow of molten material 14 through the nozzle 16, the flow of inert gas 58 into the interior may be increased, decreased, or stopped, as desired. The robotic handling device then moves the casting apparatus 10 away from the casting mold 56. The casting apparatus 10 may be purged with an inert gas prior to re-filling the casting apparatus 10 with the molten material 14.

Figure 6:
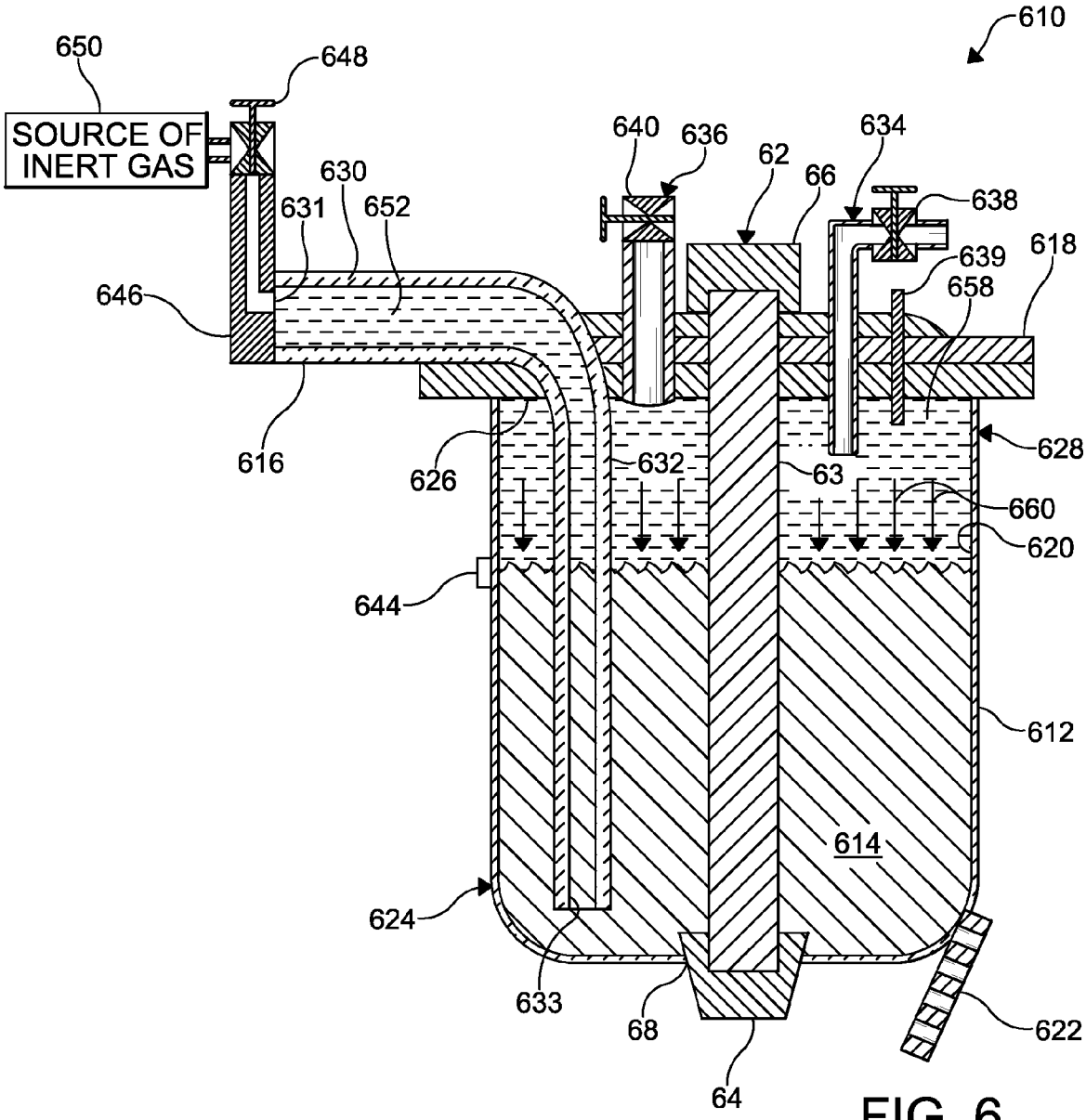
FIG. 6 is a cross-sectional elevational view of a casting apparatus according to another embodiment of the invention.

FIG. 6 shows a casting apparatus 610 according to another embodiment of the invention. The embodiment of FIG. 6 is similar to the casting apparatus 10 of FIG. 1 except as described hereinbelow. Structure repeated from FIG. 1, in FIG. 6 includes the same reference numerals with a leading 6 (e.g., 6XX).

The casting apparatus 610 includes a ladle 612 adapted to receive a molten material 614 therein, a nozzle 616 providing fluid communication with a hollow interior 620 of the ladle 612, a lid 618 forming a substantially fluid-tight seal between the interior 620 and the atmosphere, and a stopper assembly 62. It is understood that the molten material 614 may be any molten material such as a metal, for example steel, aluminum, and alloys thereof, or a polymeric material, as desired.

The ladle 612 is a quiescent-fill ladle having a dross skimmer 622 disposed on an exterior thereof. The ladle 612 has a substantially rectangular cross-sectional shape, but the ladle 612 may have any cross-sectional shape such as circular, triangular, ovoid, and the like, for example. The ladle 612 may be formed from any conventional refractory material such as a ceramic or a metal, for example, as desired. The dross skimmer 622 is a sieve adapted to skim solid material from a liquid material. The dross skimmer 622 may be a solid material including a plurality of apertures through which the molten material 614 is allowed to pass, or the dross skimmer 622 may be a mesh. The dross skimmer 622 is typically disposed on an opposite side of the ladle 612 from the nozzle 616 adjacent a bottom 624 of the ladle 612. The dross skimmer 622 may be disposed anywhere on the ladle 612, as desired. However, the dross skimmer 622 may be formed from any number of non-metallic materials adapted to withstand the elevated temperature of molten metals such as graphite or silicon carbide, for example. An opening 626 formed in a top 628 of the ladle 612 provides fluid communication with the interior 620 thereof. The opening 626 may have any size and shape as desired. In the embodiment shown, the lid 618 forms a fluid-tight seal with a portion of the ladle 612 forming the opening 626. The fluid-tight seal may be formed by welding the lid 618 to the ladle 612, with an adhesive, and the like, for example. Alternatively, the lid 618 may be integrally formed with the ladle 612, or the ladle 612 may be formed in such a way that no lid 618 is required.

The nozzle 616 is a hollow conduit providing fluid communication with the interior 620 of the ladle 612 disposed through the lid 618. The nozzle 616 includes a first portion 630 extending outwardly from the ladle 612 to an exterior thereof and a second portion 632 extending into the interior 620 of the ladle 612. The first portion 630 includes an aperture 631 forming an outlet of the nozzle 616. The second portion 632 includes an aperture 633 forming an inlet the nozzle 616. The first portion 630 has an inner diameter larger than an inner diameter of the second portion 632, but the portions 630, 632 may have the same inner diameter or the second portion 632 may have a larger inner diameter than the first portion 630, as desired. The second portion 632 is substantially linear and is substantially parallel to a longitudinal axis of the ladle 612, but the second portion 632 may be at an angle with respect to the first portion 630, as desired. The second portion 632 terminates adjacent the bottom 624 of the interior 620 of ladle 612. As shown, the nozzle 616 has a circular cross-section, but the nozzle 616 may have any cross-sectional shape, as desired. The nozzle 616 is formed from refractory material such as a ceramic or a metal, for example, as desired.

The lid 618 forms a substantially fluid-tight seal between the interior 620 and the atmosphere and includes a gas conduit 634 providing fluid communication with the interior 620, an additive feeder 636 providing communication with the interior 620, and a pressure sensor 639 in communication with the interior 620. In the embodiment shown, the lid 618 is formed from stainless steel, but the lid 618 may be formed from any resilient material adapted to withstand the elevated temperatures of a molten metal. The gas conduit 634 and the additive feeder 636 each include a portion disposed through and forming a substantially fluid tight seal with the lid 618. The gas conduit 634 includes a means for regulating flow 638 such as a valve, for example, from a source of a gas (not shown) to the interior 620 of the ladle 612. The additive feeder 636 includes a means for regulating communication 640 such as a valve, for example, from a source of an additive (not shown) to the interior 620 of the ladle 612. The source of an additive may be an individual introducing a desired amount of an additive (not shown) to the interior 620 or an additive feeder, such as a KB Alloys Rod Feeder sold by KB Alloys, Inc. of Reading, Pa. It is understood that the additive feeder 636 may be an additive feeder mounted directly to the apparatus 610. The additive added to the interior 620 may be titanium carbon aluminum, titanium aluminum, aluminum strontium, or titanium boron, etc. as desired. The gas conduit 634 and the additive feeder 636 may be formed from the same material or different materials, such as stainless steel or a ceramic, for example, as desired. The pressure sensor 639 is adapted to detect the pressure of gaseous fluids within interior 620 of the apparatus 610. The pressure sensor 639 may be in electrical communication with a computer or controller or other device adapted to receive and interpret pressure readings therefrom for fluid pressurization profile feedback and control.

The stopper assembly 62 includes a stopper rod 63 having a stopper 64 formed at a first end thereof and connected to and actuated by an actuator 66 at a second end thereof. The actuator 66 is disposed on the lid 618. The stopper rod 63 forms a substantially fluid tight seal with the lid 618. The stopper 64 forms a fluid tight seal with an aperture 68 formed in the bottom 624 of the ladle 612 when seated therein, as shown in FIG. 6. The stopper rod 63 and the stopper 64 may be formed from the same material or different materials such as a ceramic or another refractory material, for example, as desired. The stopper rod 63 and the stopper 64 may also be separately formed or integrally formed, as desired.

In use, the casting apparatus 610 is transported by a robotic handling device (not shown) as known in the art. The robotic handling device positions the casting apparatus 610 near the source of the additive with the additive feeder 636 in communication therewith. The means for regulating communication 640 is opened and a desired amount of additive from the source of the additive is introduced through the additive feeder 636 to the interior of the casting apparatus 610. Once the desired amount of additive has been introduced, the means for regulating communication 640 is closed and the casting apparatus 610 is transported to a dip well (not shown) of a furnace (not shown) for filling. To militate against the additive oxidizing prior to mixing with the molten material 614, the additive is introduced into the ladle 612 just prior to the filling thereof with the molten material 614.

To fill the casting apparatus 610 with the molten material 614, the casting apparatus 610 is lowered over the dip well until at least a portion of the dross skimmer 622 is submerged in the molten material 614. Once the portion of the dross skimmer 622 is submerged in the molten material 614, the casting apparatus 610 is caused to move in a plane parallel to a plane of a top surface of the molten material 614 to cause the dross skimmer 622 to skim the top surface of the molten material 614 to remove dross therefrom. By removing dross from the top surface of the molten material 614, the casting apparatus 610 may be lowered into the molten material 614 in an area of the dip well substantially free from dross. The casting apparatus 610 is lowered into the molten material 614 until a contact probe 644 disposed on an exterior of the ladle 612 is contacted by the molten material 614. Once the molten material 614 contacts the contact probe 644, a circuit is grounded which causes the robotic handling device to stop lowering the casting apparatus 610. Once the contact probe 644 stops the lowering of the casting apparatus 610, the actuator 66 of the stopper assembly 62 causes the stopper rod 63 to move toward the top 628 to unseat the stopper 64 from the aperture 68, thereby breaking the fluid-tight seal between the stopper 64 and the aperture 68 and allowing the molten material 614 to fill the ladle 612. By filling the ladle 612 from the bottom 624, the drop of the molten material 614 is minimized and the fill of the ladle 612 is quiescent.

Once the ladle 612 of the casting apparatus 610 is filled with a desired amount of molten material 614, the actuator 66 causes the stopper rod 63 to move toward the bottom 624 to seat the stopper 64 in the aperture 68, thereby creating a fluid-tight seal therebetween. A conduit 646 is then placed in contact and fluid communication with the aperture 631 of the first portion 630 of the nozzle 616. The conduit 646 is in fluid communication with a source of an inert gas 650 and includes a means for regulating flow 648 such as a valve, for example. The inert gas may be $N_2$, for example. The contact between the first portion 630 and the conduit 646 is substantially fluid tight. Once the first portion 630 and the conduit 646 are in fluid communication, the means for regulating flow 648 is opened and the portion of the nozzle 616 not filled with the molten material 614 is filled with an inert gas 652 from the source 650. The inert gas 652 may dilute the air (or another gas) in the nozzle 616, or the inert gas 652 may displace the air which is selectively vented from the nozzle 616. Once the nozzle 616 is filled with a desired amount of the inert gas 652, the means for regulating flow 648 is closed. By filling the nozzle 616 with the inert gas 652 after the apparatus 610 is filled with the molten material 614, oxidation of the molten material 614 is minimized. Once the means for regulating flow 648 is closed, contact between the conduit 646 and the first portion 630 is broken, and the aperture 631 of the nozzle 616 is sealed with a cover (not shown) to militate against the escape of the inert gas 652 therefrom. The cover may be hingedly or otherwise connected to the casting apparatus 610 or formed separately from the casting apparatus 610, as desired. The cover may be a plug or other capping device, as desired. The casting apparatus 610 is then removed from the dip well and the molten material 614 by the robotic handling device. Alternative to using the cover, the conduit 646 may remain in fluid-tight contact with the nozzle 616 during transport of the casting apparatus 610 from the dip well.

After filling, the casting apparatus 610 is transported by the robotic handling device to a casting mold (not shown). The cover is removed from the aperture 631 of the nozzle 616 and the nozzle 616 is sealingly connected to the casting mold with the aperture 631 in fluid communication with an aperture (not shown) formed in the casting mold. Once the casting apparatus 610 and the casting mold are connected, the means for regulating flow 638 is opened and an inert gas 658 is caused to flow into the interior 620 to pressurize the ladle 612. As indicated by arrows 660, the pressure in the interior 620 causes a downward pressure on the molten material 614 and causes the molten material 614 to flow through the aperture 633, through the nozzle 616 and from the aperture 631 into the casting mold. Once the casting mold is filled to a desired level, the means for regulating flow 638 is closed to stop the flow of inert gas 658 into the interior 620. Based on a fluid pressure measurement from the pressure sensor 639 and a desired flow of molten material 614 through the nozzle 616, the flow of inert gas 658 into the interior may be increased, decreased, or stopped, as desired. The robotic handling device then moves the casting apparatus 610 away from the casting mold. The casting apparatus 610 may be purged with an inert gas prior to re-filling the casting apparatus 610 with the molten material 614.

Figure 7:
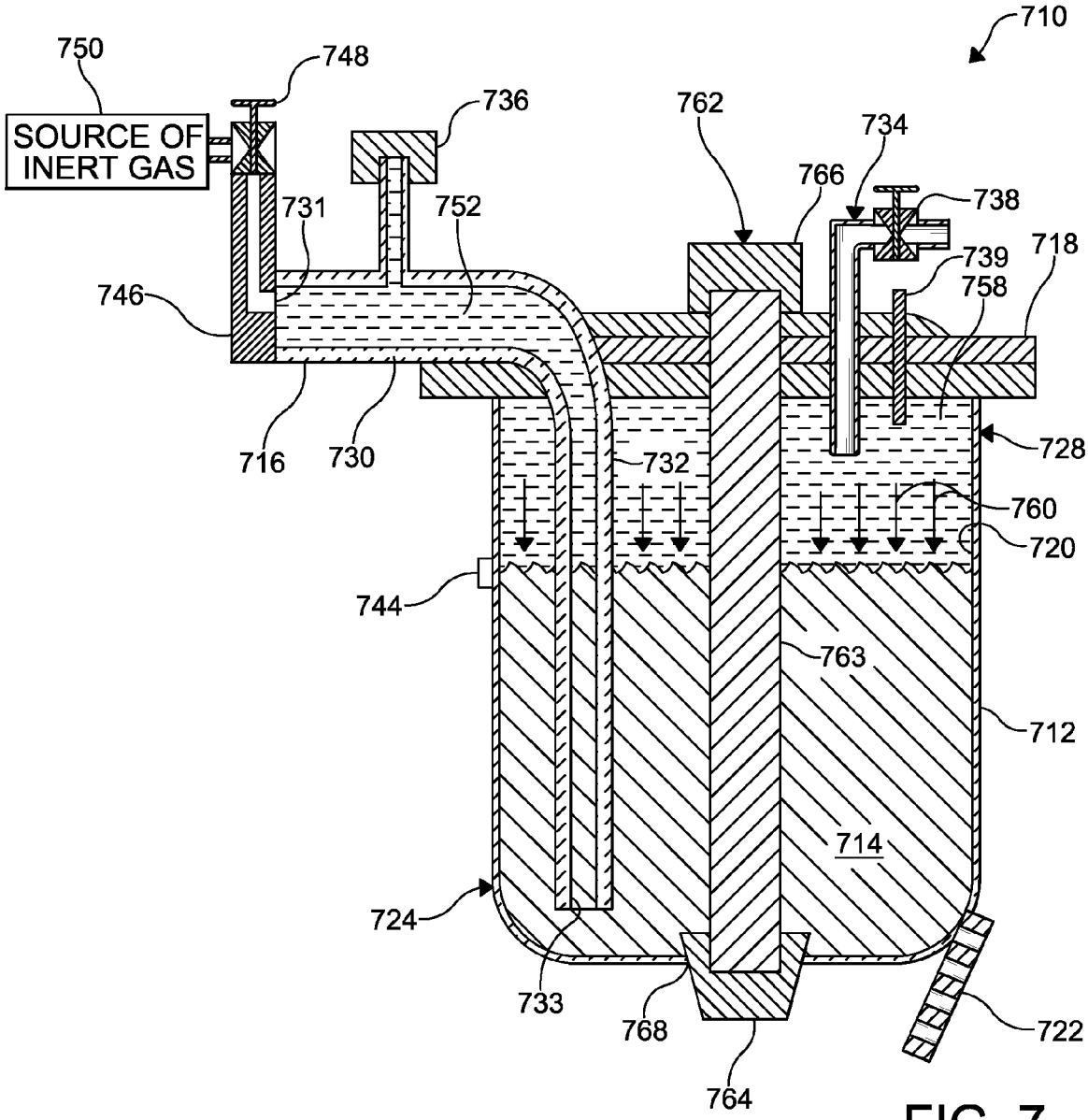
FIG. 7 is a cross-sectional elevational view of a casting apparatus according to another embodiment of the invention.

FIG. 7 shows a casting apparatus 710 according to another embodiment of the invention. The embodiment of FIG. 7 is similar to the casting apparatus 610 of FIG. 6 except as described hereinbelow. Structure repeated from FIG. 6, in FIG. 7 includes the same reference numerals with a leading 7 (e.g., 7XX).

The casting apparatus 710 includes a ladle 712 adapted to receive a molten material 714 therein, a nozzle 716 providing fluid communication with an interior 720 of the ladle 712, a lid 718 forming a substantially fluid-tight seal between the interior 720 of the ladle 712 and the atmosphere, and a stopper rod 763. It is understood that the molten material 714 may be any molten material such as a metal, for example steel, aluminum, and alloys thereof, or a polymeric material, as desired.

The nozzle 716 is a hollow conduit providing fluid communication with the interior 720 of the ladle 712 disposed through the lid 718. The nozzle 716 includes a first portion 730 extending outwardly from the ladle 712 to an exterior thereof and a second portion 732 extending into the interior 720 of the ladle 712. The first portion 730 includes an aperture 731 providing communication to the nozzle 716. The second portion 732 includes an aperture 733 providing fluid communication through the nozzle 716. The first portion 730 has an inner diameter larger than an inner diameter of the second portion 732, but the portions 730, 732 may have the same inner diameter or the second portion 732 may have a larger inner diameter than the first portion 730, as desired. An additive feeder 736 is in fluid communication with the first portion 730. At least a portion of the additive feeder 736 is disposed through and forms a fluid-tight seal with the first portion 730. The additive feeder 736 is an additive feeder, such as a KB Alloys Rod Feeder sold by KB Alloys, Inc. of Reading, Pa. The additive feeder 736 may include a valve or other means for regulating communication with the nozzle 716, as desired. The second portion 732 is substantially linear and is substantially parallel to a longitudinal axis of the ladle 712, but the second portion 732 may be at an angle with respect to the longitudinal axis, as desired. The second portion 732 terminates adjacent a bottom 724 of the interior 720 of ladle 712. The nozzle 716 has a circular cross-section, but the nozzle 716 may have any cross-sectional shape, as desired. The nozzle 716 is formed from refractory material such as a ceramic or a metal, for example, as desired.

In use, the casting apparatus 710 is transported by a robotic handling device (not shown) as known in the art. To fill the casting apparatus 710 with the molten material 714, the casting apparatus 710 is lowered over the dip well until at least a portion of a dross skimmer 722 is submerged in the molten material 714. Once the portion of the dross skimmer 722 is submerged in the molten material 714, the casting apparatus 710 is caused to move in a plane parallel to a plane of a top surface of the molten material 714 to cause the dross skimmer 722 to skim the top surface of the molten material 714 to remove dross therefrom. By removing dross from the top surface of the molten material 714, the casting apparatus 710 may be lowered into the molten material 714 in an area of the dip well substantially free from dross. The casting apparatus 710 is lowered into the molten material 714 until a contact probe 744 disposed on an exterior of the ladle 712 is contacted by the molten material 714. Once the molten material 714 contacts the contact probe 744, a circuit is grounded which causes the robotic handling device to stop lowering the casting apparatus 710. Once the contact probe 744 stops the lowering of the casting apparatus 710, an actuator 766 of the stopper assembly 762 causes a stopper rod 763 of a stopper assembly 762 to move toward a top 728 of the ladle 712 to unseat a stopper 764 from an aperture 768 formed in the bottom 724 of the ladle 712, thereby breaking the fluid-tight seal between the stopper 764 and the aperture 768 and allowing the molten material 714 to fill the ladle 712. By filling the ladle 712 from the bottom 724, the drop of the molten material 714 is minimized and the fill of the ladle 712 is quiescent.

Once the ladle 712 of the casting apparatus 710 is filled with a desired amount of molten material 714, the actuator 766 causes the stopper rod 763 to move toward the bottom 724 to seat the stopper 764 in the aperture 768, thereby creating a fluid-tight seal therebetween. A conduit 746 is then placed in contact and fluid communication with the aperture 731 of the first portion 730 of the nozzle 716. The conduit 746 is in fluid communication with a source of an inert gas 750 and includes a means for regulating flow 748 such as a valve, for example. The inert gas may be $N_2$, for example. The contact between the first portion 730 and the conduit 746 is substantially fluid tight. Once the first portion 730 and the conduit 746 are in fluid communication, the means for regulating flow 748 is opened and the portion of the nozzle 716 not filled with the molten material 714 is filled with an inert gas 752 from the source 750. The inert gas 752 may dilute the air (or another gas) in the nozzle 716, or the inert gas 752 may displace the air which is selectively vented from the nozzle 716. Once the nozzle 716 is filled with a desired amount of inert gas, the means for regulating flow 748 is closed. By filling the nozzle 716 with the inert gas 752 after the apparatus 710 is filled with the molten material 714, oxidation of the molten material 714 is minimized. Once the means for regulating flow 748 is closed, contact between the conduit 746 and the first portion 730 is broken, and the aperture 731 of the nozzle 716 is sealed with a cover (not shown) to militate against the escape of the inert gas 752 therefrom. The cover may be hingedly or otherwise connected to the casting apparatus 710 or formed separately from the casting apparatus 710, as desired. The cover may be a plug or other capping device, as desired. The casting apparatus 710 is then removed from the dip well and the molten material 714 by the robotic handling device. Alternative to using the cover, the conduit 746 may remain in fluid-tight contact with the nozzle 716 during transport of the casting apparatus 710 from the dip well.

After filling, the casting apparatus 710 is transported by the robotic handling device to a casting mold (not shown). The cover is removed from the aperture 731 of the nozzle 716 and the nozzle 716 is sealingly connected to the casting mold with the aperture 731 in fluid communication with an aperture (not shown) formed in the casting mold. Once the casting apparatus 710 and the casting mold are connected, a means for regulating flow 738 of a gas conduit 734 is opened and an inert gas 758 is caused to flow into the interior 720 to pressurize the ladle 712. A pressure sensor 739 disposed through the lid 718 and in communication with the interior 720 measures the fluid pressure of the inert gas 758. The fluid pressure measurement may be transmitted to a computer or controller or other device adapted to receive and interpret pressure readings for fluid pressurization profile feedback and control. As indicated by arrows 760, the pressure in the interior 720 causes a downward pressure on the molten material 714 and causes the molten material 714 to flow through the aperture 733, through the nozzle 716 and from the aperture 731 into the casting mold. Based on the fluid pressure measurement and a desired flow of molten material 714 through the nozzle 716, the flow of inert gas 758 into the interior may be increased, decreased, or stopped, as desired. As the molten material 714 is caused to flow into the casting mold, additive is fed at a desired rate from the additive feeder 736 into the nozzle 716. By introducing the additive into the molten material 714 just prior to introduction of the molten material 714 into the casting mold, mixing of the additive with the molten material 714 is ensured.

Once the casting mold is filled to a desired level, the means for regulating flow 738 is closed to stop the flow of inert gas 758 into the interior 720. The robotic handling device then moves the casting apparatus 710 away from the casting mold. The casting apparatus 710 may be purged with an inert gas prior to re-filling the casting apparatus 710 with the molten material 714.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. A method of transferring a molten material to a casting mold, the method comprising:

lowering a ladle having a hollow interior into a source of molten material and an aperture facilitating flow into the hollow interior;

filling the interior of the ladle with the molten material through the aperture;

introducing an inert gas into a portion of a nozzle;

removing the ladle from the source of molten material;

causing the nozzle to contact a casting mold; and pressurizing the hollow interior with an inert gas to cause the molten material to flow into the casting mold through the nozzle.

2. The method of claim 1, further comprising introducing an additive to the hollow interior prior to the filling step.

3. The method of claim 1, further comprising introducing an additive to the molten material through the nozzle during the pressurizing the hollow interior with the inert gas to cause the molten material to flow into the casting mold step.

4. The method of claim 1, further comprising lowering the ladle into the molten material until a portion of a dross skimmer disposed on an exterior of the ladle is submerged therein and skimming a surface of the molten material with the dross skimmer by moving the ladle across the surface of the molten material.

5. The method of claim 4, further comprising rotating the ladle until a portion of the nozzle disposed on an exterior of the ladle is submerged in the molten material to facilitate the filling step.

6. The method of claim 1, further comprising actuating a stopper assembly to unseat a stopper forming a fluid-tight seal with an aperture formed in a bottom of the ladle to facilitate the filling step.

7. The method of claim 6, further comprising purging the ladle with an inert gas.

8. The method of claim 1, wherein the lowering and removing steps are conducted using a mechanical or a robotic handling device.

9. The method of claim 1, wherein the causing the nozzle to contact a casting mold step is conducted using a mechanical or a robotic handling device.

10. The method of claim 1, wherein the lowering, removing, and causing the nozzle to contact a casting mold steps are conducted using a mechanical or a robotic handling device.

11. A method of transferring a molten material to a casting mold, the method comprising:

lowering a ladle into a source of molten material using a mechanical or a robotic handling device, the ladle having a hollow interior and an aperture facilitating flow into the hollow interior;

filling the interior of the ladle with the molten material through the aperture;

introducing an inert gas into a portion of a nozzle;

removing the ladle from the source of molten material using the mechanical or the robotic handling device;

causing the nozzle to contact a casting mold; and pressurizing the hollow interior with an inert gas to cause the molten material to flow into the casting mold through the nozzle.

12. The method of claim 11, further comprising introducing an additive to the hollow interior prior to the filling step.

13. The method of claim 11, further comprising introducing an additive to the molten material through the nozzle during the pressurizing the hollow interior with the inert gas to cause the molten material to flow into the casting mold.

14. The method of claim 11, further comprising lowering the ladle into the molten material until a portion of a dross skimmer disposed on an exterior of the ladle is submerged therein and skimming a surface of the molten material with the dross skimmer by moving the ladle across the surface of the molten material.

15. The method of claim 14, further comprising rotating the ladle until a portion of the nozzle disposed on an exterior of the ladle is submerged in the molten material to facilitate the filling step.

16. The method of claim 11, further comprising actuating a stopper assembly to unseat a stopper forming a fluid-tight seal with an aperture formed in a bottom of the ladle to facilitate the filling step.

17. The method of claim 16, further comprising purging the ladle with an inert gas.

18. The method of claim 11, wherein the causing the nozzle to contact a casting mold step is conducted using the mechanical or the robotic handling device.

19. The method of claim 11, wherein the lowering and causing the nozzle to contact a casting mold steps are conducted using the mechanical or the robotic handling device.

20. A method of transferring a molten material to a casting mold, the method comprising:

lowering a ladle into a source of molten material using a mechanical or a robotic handling device, the ladle having a hollow interior and an aperture facilitating flow into the hollow interior;

filling the interior of the ladle with the molten material through the aperture;

introducing an inert gas into a portion of a nozzle;

removing the ladle from the source of molten material using the mechanical or the robotic handling device;

causing the nozzle to contact a casting mold using the mechanical or the robotic handling device; and pressurizing the hollow interior with an inert gas to cause the molten material to flow into the casting mold through the nozzle.

* * * * *